US005451996A

United States Patent [19]

Awai et al.

[11] Patent Number: 5,451,996

[45] Date of Patent: Sep. 19, 1995

[54] MULTIPRINT INK SHEET CARTRIDGE AND RECORDING APPARATUS CAPABLE OF MOUNTING THE SAME

[75] Inventors: Takashi Awai; Minoru Yokoyama; Akihiro Tomoda, all of Yokohama; Yasushi Ishida, Tokyo; Masakatsu Yamada, Yokohama, all of Japan

[73] Assignee: Canon Kabushiki Kaisha, Tokyo, Japan

[21] Appl. No.: 225,931

[22] Filed: Apr. 11, 1994

Related U.S. Application Data

[63] Continuation of Ser. No. 3,872, Jan. 11, 1993, abandoned, which is a continuation of Ser. No. 555,712, Jul. 23, 1990, abandoned.

[30] Foreign Application Priority Data

Jul. 21, 1989 [JP] Japan ..... 1-187487
Jun. 8, 1990 [JP] Japan ..... 2-148540

[51] Int. Cl.[6] ..... B41J 32/00

[52] U.S. Cl. ..... 347/214; 400/207; 400/208; 400/208.1; 400/236; 400/236.2; 347/217

[58] Field of Search ..... 400/207, 208, 208.1, 400/223, 224.1, 224.2, 225, 227, 232, 236, 236.1, 236.2, 120; 346/76 PH; 358/296; 347/214, 217

[56] References Cited

U.S. PATENT DOCUMENTS

| | | | |
|---|---|---|---|
| 4,456,392 | 6/1984 | Nozaki et al. | 400/120 |
| 4,702,631 | 10/1987 | Watanabe | 400/236.2 |
| 4,764,041 | 8/1988 | Bierhoff | 400/208 |
| 4,812,063 | 3/1989 | Kunimitsu | 400/236.2 |
| 4,910,602 | 3/1990 | Sakuragi | 346/76 PH |
| 4,914,452 | 4/1990 | Fukawa | 400/207 |
| 4,924,242 | 5/1990 | Fukawa | 400/208 |
| 5,011,310 | 4/1991 | Wiechert | 400/207 |

*Primary Examiner*—Huan H. Tran
*Attorney, Agent, or Firm*—Fitzpatrick, Cella, Harper & Scinto

[57] ABSTRACT

An ink sheet cartridge mountable on a recording apparatus includes a frame, an ink sheet provided in the frame, a takeup reel for winding the ink sheet, a supply reel for unwinding the ink sheet, and a driving force transmission means for transmitting a driving force to the ink sheet changing a driving speed from the side of the recording apparatus so as to move the ink sheet from the supply reel to the takeup reel with a moving speed corresponding to the kind of the ink sheet, The recording apparatus can mount the ink sheet cartridge.

29 Claims, 11 Drawing Sheets

FIG. 9

| KIND OF MULTIPRINT INK SHEET | NUMBER OF TEETH OF TAKEUP-REEL GEAR 3C | NUMBER OF TEETH OF GEAR 101a | MOVING SPEED OF INK SHEET RELATIVE TO RECORDING PAPER |
|---|---|---|---|
| FOR 3 TIMES | 33 | 39 | 1 / 3.02 |
| FOR 4 TIMES | 38 | 34 | 1 / 3.99 |
| FOR 5 TIMES | 42 | 30 | 1/5 |
| FOR 6 TIMES | 45 | 27 | 1 / 5.95 |
| FOR 7 TIMES | 48 | 24 | 1 / 7.14 |
| FOR 8 TIMES | 50 | 22 | 1 / 8.12 |
| FOR 9 TIMES | 52 | 20 | 1 / 9.29 |
| FOR 10 TIMES | 53 | 19 | 1 / 9.96 |

MULTIPRINT INK SHEET CARTRIDGE AND RECORDING APPARATUS CAPABLE OF MOUNTING THE SAME

This application is a continuation of application Ser. No. 08/003,872 filed Jan. 11, 1993, now abandoned, which is a continuation of application Ser. No. 07/555,712 filed Jul. 23, 1990, now abandoned.

BACKGROUND OF THE INVENTION

1. Field of the Invention

This invention relates to an ink sheet cartridge for use in a thermal transfer recording method, and to a recording apparatus capable of mounting the ink sheet cartridge.

2. Description of the Related Art

A thermal transfer printer generally uses an ink sheet made by coating thermofusible (or thermosublimable or the like) ink on a base film, and records an image by using a thermal print head to selectively heat the ink sheet in accordance with image signals thereby transferring fused (or sublimated or the like) ink to the recording paper. Ink sheets used in such a thermal transfer printer crease easily because they are in general very thin, and it is difficult to mount the ink sheet on the main body of a printer without producing creases. Therefore it takes extra time to mount the ink sheet. In order to solve this problem, a method has been proposed in which such an ink sheet is housed within a cartridge, and the entire cartridge is mounted on or exchanged from the main body of an apparatus.

Such an ink sheet is of a type in which ink is completely transferred to the recording paper in a single recording operation (a so-called one-time ink sheet), Accordingly, after the completion of recording of one character or one line, it is necessary to move the ink sheet by a length corresponding to the length of the recording and to securely bring the unused portion of the ink sheet to a position for use in subsequent recording. Hence, the amount of ink sheet used increases, and the operating cost for a thermal transfer printer with one-time ink sheets becomes higher than that for a multiple use ink sheet thermal printer in which recording is performed on thermo-sensitive paper. As an ink sheet for thermal transfer recording for solving such a problem, an ink sheet (a so-called multiprint ink sheet) has been known which can record images a plurality of times. By using a multiprint ink sheets when recording n times a recording length L, recording can be performed calculating the length of the ink sheet to be moved after the completion of each recording or during recording smaller ($L/n$: $n>1$) than the length L. The efficiency of use of the ink sheet thereby becomes n times that in conventional cases, and hence reduction in the running cost of a thermal transfer printer can be expected. Such a recording method will be hereinafter termed "multiprint".

For such an ink sheet for multiprint, an ink sheet cartridge (hereinafter simply termed a "cartridge") housing the ink sheet may also be mounted on a thermal transfer printer to perform recording, as in the case of using a conventional one-time ink sheet. However, a cartridge housing an ink sheet capable of performing 3-times multiprint can only be used efficiently in a thermal transfer printer capable of 3-times multiprint. Thus, for example, if a cartridge housing an ink sheet capable of performing 10-times multiprint is used with the above-described thermal transfer printer which is capable only of performing 3-times multiprint, the 10-times multiprint ink sheet functions only as a 3-times multiprint ink sheet, since the printer is for 3-times multiprint and the moving length of the ink sheet relative to the moving length of recording paper is set to $\frac{1}{3}$.

SUMMARY OF THE INVENTION

It is an object of the present invention to provide an ink sheet cartridge applicable to a thermal transfer recording method, and a recording apparatus capable of mounting the ink sheet cartridge.

It is a further object of the present invention to provide an ink sheet cartridge applicable to multiprint, and a recording apparatus capable of mounting the ink sheet cartridge.

It is a still further object of the present invention to provide an ink sheet cartridge capable of moving an ink sheet at a predetermined speed, and a recording apparatus capable of mounting the ink sheet cartridge.

It is still a further object of the present invention to provide an ink sheet cartridge capable of performing clear recording, and a recording apparatus capable of mounting the ink sheet cartridge.

It is still another object of the present invention, which has been made in consideration of the above-described conventional examples, to provide an ink sheet cartridge applicable to even an ink sheet for multiprint having any magnification, and a recording apparatus using the ink sheet cartridge.

BRIEF DESCRIPTION OF THE DRAWINGS

FIG. 9 is a chart showing an example of combination of the numbers of teeth of a takeup gear and a two-stage gear for each of multiprint sheets;

DETAILED DESCRIPTION OF THE PREFERRED EMBODIMENT

The preferred embodiment of the present invention will now be explained in detail by reference to the attached drawings.

Figure 1:
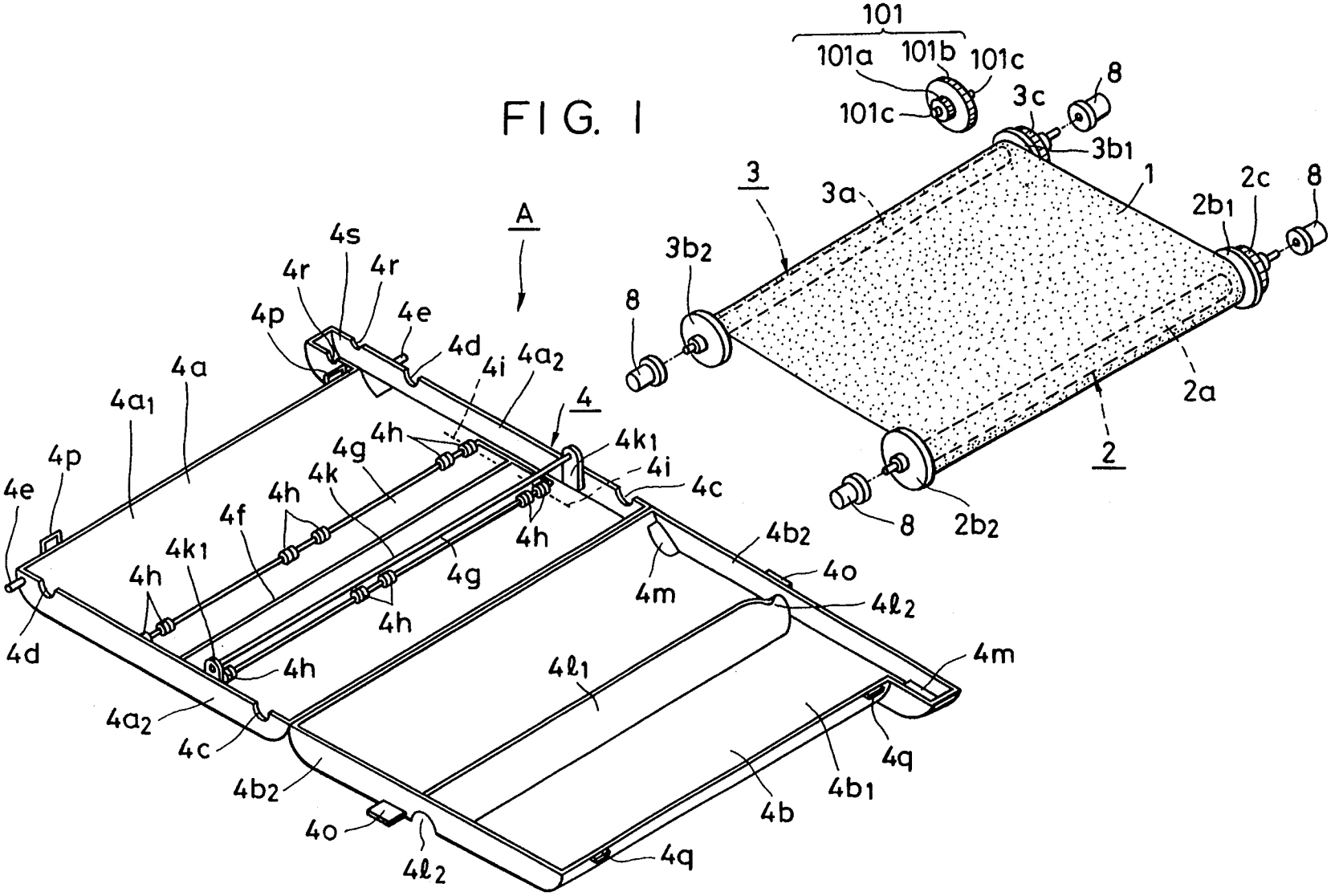
FIG. 1 is a perspective view of an ink sheet cartridge in an opened position and with the ink sheet removed according to an embodiment of the present invention.
Figure 2:
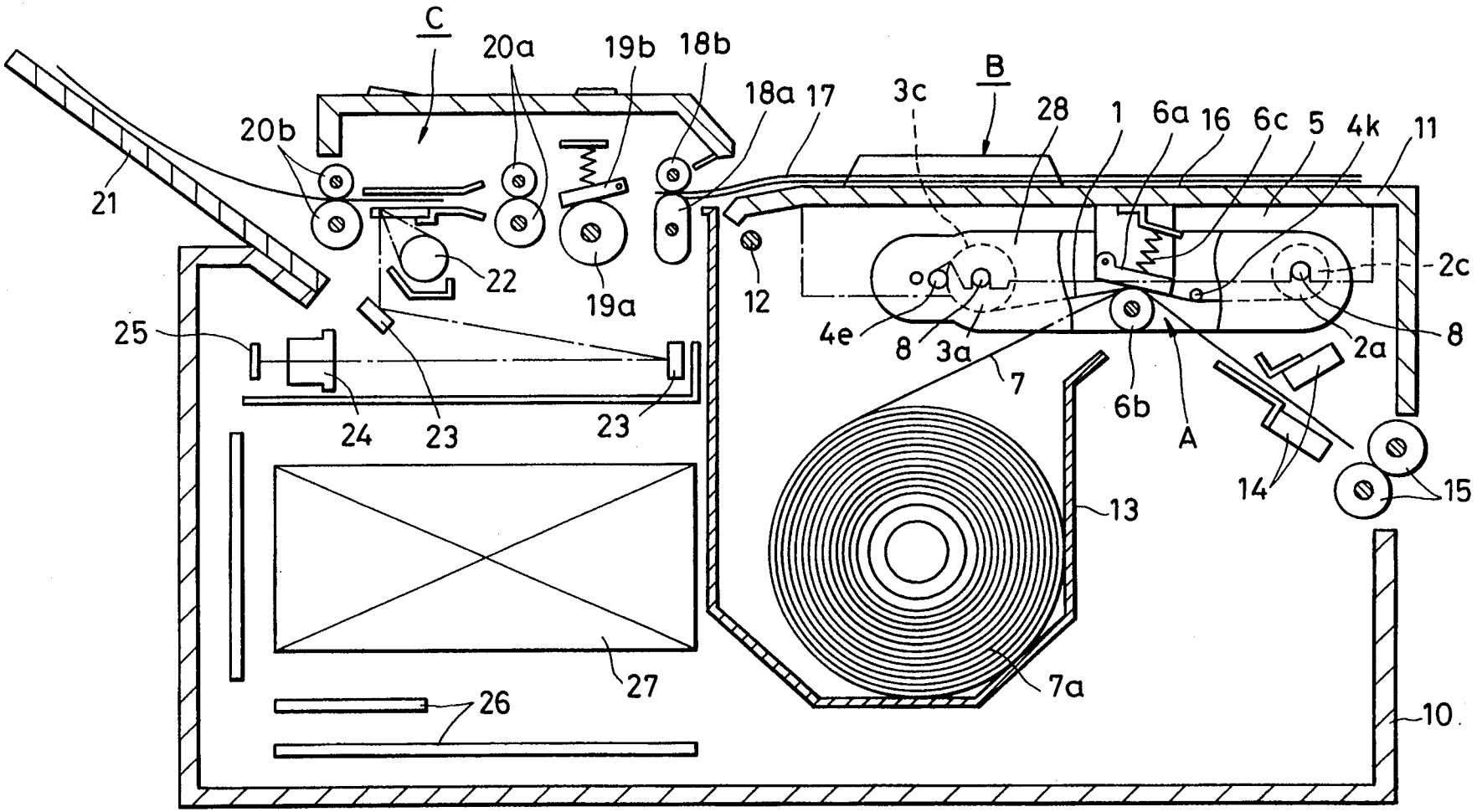
FIG. 2 is a cross-sectional view of an entire recording apparatus mounting the ink sheet cartridge.

FIG. 1 is a diagram for explaining the configuration of a cartridge A according to the embodiment to which the present invention is applied. FIG. 2 is a diagram for explaining the configuration of a recording apparatus B mounting the cartridge A.

First, an outline of the entire configuration will be explained. The cartridge A is configured so that an ink sheet 1 having the shape of a long sheet is wound around a supply reel 2 and a takeup reel 3. Reels 2 and 3 are rotatably housed within a receptacle 4. The cartridge A is also configured so as to be positioned and mounted on a mounting unit 5 of the recording apparatus B. As will be described later, the recording apparatus B is configured so that, when the ink sheet 1 and a recording sheet 7 are moved through a recording unit consisting of a recording head 6*a* and a platen roller 6*b*, ink on the ink sheet 1 is transferred to the recording sheet 7 due to heating by the recording head 6*a*, and an image pattern is formed on the recording sheet 7.

Next, the specific configuration of the cartridge A will be explained by reference to FIG. 1. FIG. 1 is a perspective view showing a state in which the cartridge A is opened and the ink sheet 1 is taken out.

As will be described in detail later by reference to FIG. 11, the ink sheet 1 according to the embodiment, having a width of B4- or A4-format, is made by coating thermotransferrable (thermofusible, thermosublimable or the like) ink on a support sheet having the shape of a long sheet. When the support sheet is heated, the ink is, for example, fused in accordance with a heating pattern. The ink sheet 1 is an ink sheet for multiprint. One end of the long sheet of the ink sheet 1 is wound around the supply reel 2, and another end thereof is wound around the takeup reel 3.

As shown in FIG. 1, collars $2b_1$ and $2b_2$, and $3b_1$ and $3b_2$ are formed at both ends of respective reel shafts 2*a* and 3*a* of the supply reel 2 and the takeup reel 3. Reel gears 2*c* and 3*c* are formed as one body on the respective collars $2b_1$ and $3b_1$ of the reels 2 and 3. A small gear 101*a* of a two-stage gear 101 engages takeup-reel gear 3*c* so as to mesh with it. Both ends of the reel shafts 2*a* and 3*a* are configured so as to protrude outside the reel gears 2*c* and 3*c*, and collars $2b_2$ and $3b_2$, respectively. Bearings 8 are rotatably fitted onto both ends of each of reel shafts 2*a* and 3*a*. The reels 2 and 3 around which the ink sheet 1 is wound are housed within receptacle 4, the configuration of which will now be explained.

As shown in FIG. 1, the receptacle 4 is configured so that a first casing 4*a* and a second casing 4*b* are rotatably coupled by hinges or the like (not shown), whereby the receptacle 4 can be opened or closed.

The first casing 4*a* is configured so that side plates $4a_2$ stand at two sides of a substrate $4a_1$, another two end portions of which have the shape of a circular arc. Each of the side plates $4a_2$ is configured so that a pair of U-grooves 4*c* and 4*d* are formed at predetermined right and left positions with a predetermined spacing therebetween. By fitting the bearing 8 of the supply reel 2 with the U-groove 4*c* and fitting the bearing 8 of the takeup reel 3 with the U-groove 4*d*, the supply reel 2 and the takeup reel 3 are mounted on the first casing 4*a*. A pair of U-grooves 4*r* are also provided at the side of the side plate $4a_2$ on which the reel gears 2*c* and 3*c* are mounted. A shaft 101*c* of the two-stage gear 101 is fitted with the U-grooves 4*r*. The two-stage gear 101 is thereby housed within a recess 4*s*. The two-stage gear 101 comprises the small gear 101*a* and a large gear 101*b* which are mounted as one body on the common shaft 101*c*. The small gear 101*a* meshes with the takeup-reel gear 3*c* which is also provided in the cartridge A. The large gear 101*b* meshes with a driving force transmission gear 31 which is provided in the recording apparatus B.

Guide pins 4*e* for mounting the cartridge A on the recording apparatus B are provided on an extended line connecting the respective U-grooves 4*c* and 4*d* and protrude from end portions of the two side plates $4a_2$. As will be described later, the guide pins 4*e* become centers of rotation when the cartridge A is mounted on the recording apparatus B.

Figure 3A:
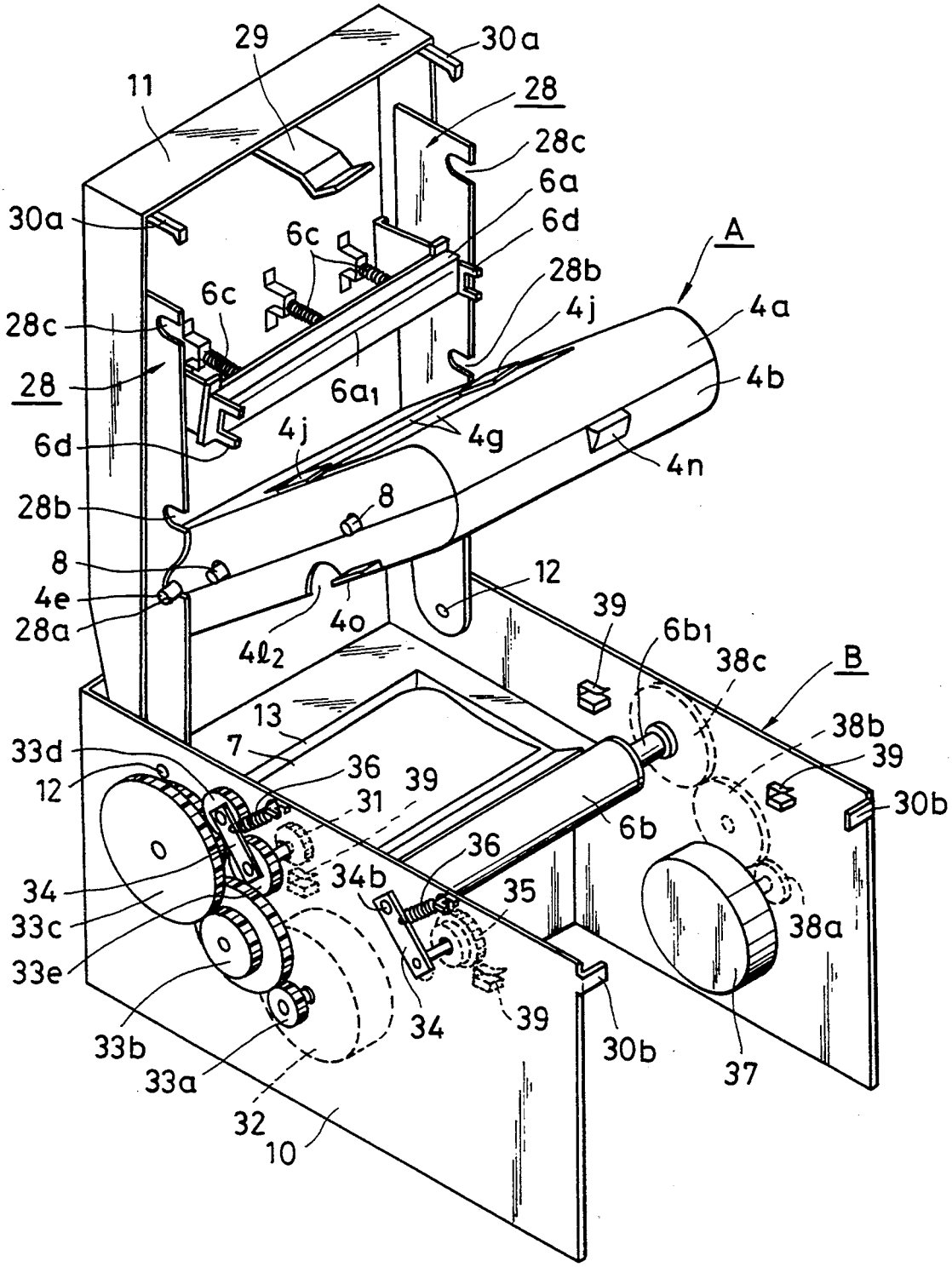
FIGS. 3(A) and 3(B) are perspective views of a portion of the recording apparatus where the ink sheet cartridge is mounted on the recording apparatus.

In addition, an opening 4*f* for receiving the recording head 6*a* within the cartridge A is provided at a predetermined position of the substrate $4a_1$, more specifically, at a position approximately equidistant between U-grooves 4*c* and 4*d*. Two identical covers 4*g* openable from the center of the opening 4*f* are mounted at the opening 4*f*. That is, each of the covers 4*g* is mounted so as to be rotatable relative to the substrate $4a_1$ by hinges 4*h*, and a torsion coil spring 4*i* is provided at an end portion of each cover 4*g*. The covers 4*g* are outwardly pressed from the inside of the receptacle by springs 4*i*. As shown in FIG. 3(A), regulating plates 4*j* for regulating the energization of the covers 4*g* by the torsion coil springs 4*i* are provided at predetermined positions of the substrate $4a_1$.

Standing pieces $4k_1$ are attached to the sides of the inner walls of the two side plates $4a_2$ and are near positions where the takeup reel 3 is mounted. Standing pieces $4k_1$ protrude above the top of side plates $4a_2$. A guide shaft 4*k* for guiding the movement of the ink sheet 1, as will be described later, is provided between the standing pieces $4k_1$.

In the second casing 4*b*, as in the first casing 4*a*, side plates $4b_2$ are provided in a standing state at two sides of the substrate $4b_1$, the two end portions of which have the shape of a circular arc. At a nearly central portion of the substrate $4b_1$, a window $4l_1$ is provided for receiving a platen roller 6*b*, provided in the recording apparatus B, within the cartridge A when the cartridge A is mounted within the apparatus B. Notches $4l_2$ for receiving the platen roller shaft are formed in the two side plates $4b_2$ in continuation with the window $4l_1$.

At predetermined positions in the substrate $4b_1$, openings 4*m* are provided for exposing the gear 2*c* of the supply reel 2 and the gear 101*b* of the two-stage gear 101 housed within the receptacle 4. The gears 2*c* and 101*b* exposed from the openings 4*m* are connected to a motor mounted on the recording apparatus B, as will be described later, to transmit the motor's rotation force to the supply reel 2 and the takeup reel 3.

As shown in FIG. 3(A), an anchoring projection 4*n* protrudes from the second casing 4*b* at an end portion at the side of the hinges of the second casing 4*b*. By anchoring the anchoring projection 4*n* with an anchoring leaf spring 29 in the mounting unit 5, which will be described later, the cartridge A is mounted in position on the recording apparatus B. Furthermore, knobs 4*o* are provided so as to protrude outwardly from the side plates $4b_2$ of the second casing 4*b*. When the cartridge A mounted on the recording apparatus B is demounted, the operator can release the anchored state of the anchoring projection 4*n* with the anchoring spring 29 while grasping the knobs 4*o*. Anchoring recesses 4*p* are provided at the end of the first casing 4*a*, and anchoring projections 4*q* for anchoring with the anchoring recesses 4*p* are provided at the end of the second casing 4*b*. Thus, when the two casings 4*a* and 4*b* are closed together, the anchoring recesses 4p and the anchoring projections 4q engage to maintain the cartridge A closed.

Next, an explanation will be provided of the configuration of the recording apparatus B for performing thermal transfer recording while mounting the cartridge A.

As shown in FIG. 2, a recording apparatus B according to the present embodiment is configured as a recording system of a facsimile including an image reading system C. The recording apparatus B is configured so that a recording cover 11 can be opened or closed from a main body 10 of the apparatus by its rotation around a hinge shaft 12. The cartridge A is mounted within the recording cover 11.

In the main body 10 of the apparatus, there is provided a roll holder 13 for holding a sheet roll 7a obtained by winding the long recording sheet 7 into the shape of a roll. The main body 10 also includes a platen roller 6b, which serves as a conveying means for conveying the recording sheet 7, a cutter 14 for cutting the recording sheet 7 after recording, and discharge rollers 15 for discharging the sheet 7 from the main body.

As shown in FIGS. 2 and 3(A), a line-type recording head 6a, consisting of a plurality of heating elements $6a_1$ aligned in a single line for producing heat in accordance with an image signal, is mounted at the side of the recording cover 11. The apparatus is configured so that, when the recording cover 11 is closed, the recording head 6a is urged by pressing springs 6c to press the platen roller 6b. The apparatus is also configured so that, when the recording cover 11 is closed, fork members 6d mounted at both ends of the recording head 6a grasp the shaft $6b_1$ of the platen roller 6b to thereby position the recording head 6a.

Next, an explanation will be provided of the image reading system C. First, a plurality of laminated sheets of original 17 are placed on an original mounting unit 16 provided on the upper surface of the recording cover 11, and the sheets of the original 17 are preliminarily conveyed by a preliminary conveying roller 18a and a pressing roller 18b. Each sheet of the original 17 is fed separated by a separation roller 19a and a pressing piece 19b pressing thereagainst. The separated sheet of the original 17 is then conveyed by pairs of conveying rollers 20a and 20b, and is discharged onto a discharge tray 21 after an image on the sheet of the original 17 has been read. As the sheet of the original 17 is conveyed, light is projected from a light source 22 onto the surface of the original 17, and light reflected from the surface is guided up to a photoelectric conversion device 25, such as a CCD or the like, via mirrors 23 and a lens 24. An image signal from the photoelectric conversion device 25 is transmitted to the recording system of the apparatus when it is in a copy mode and to the recording system of the remote apparatus when it is in the transmission mode.

In FIG. 2, electronic components are mounted on substrates 26. A power supply 27 drives members, such as a motor and the like, which will be described later.

Figure 4:
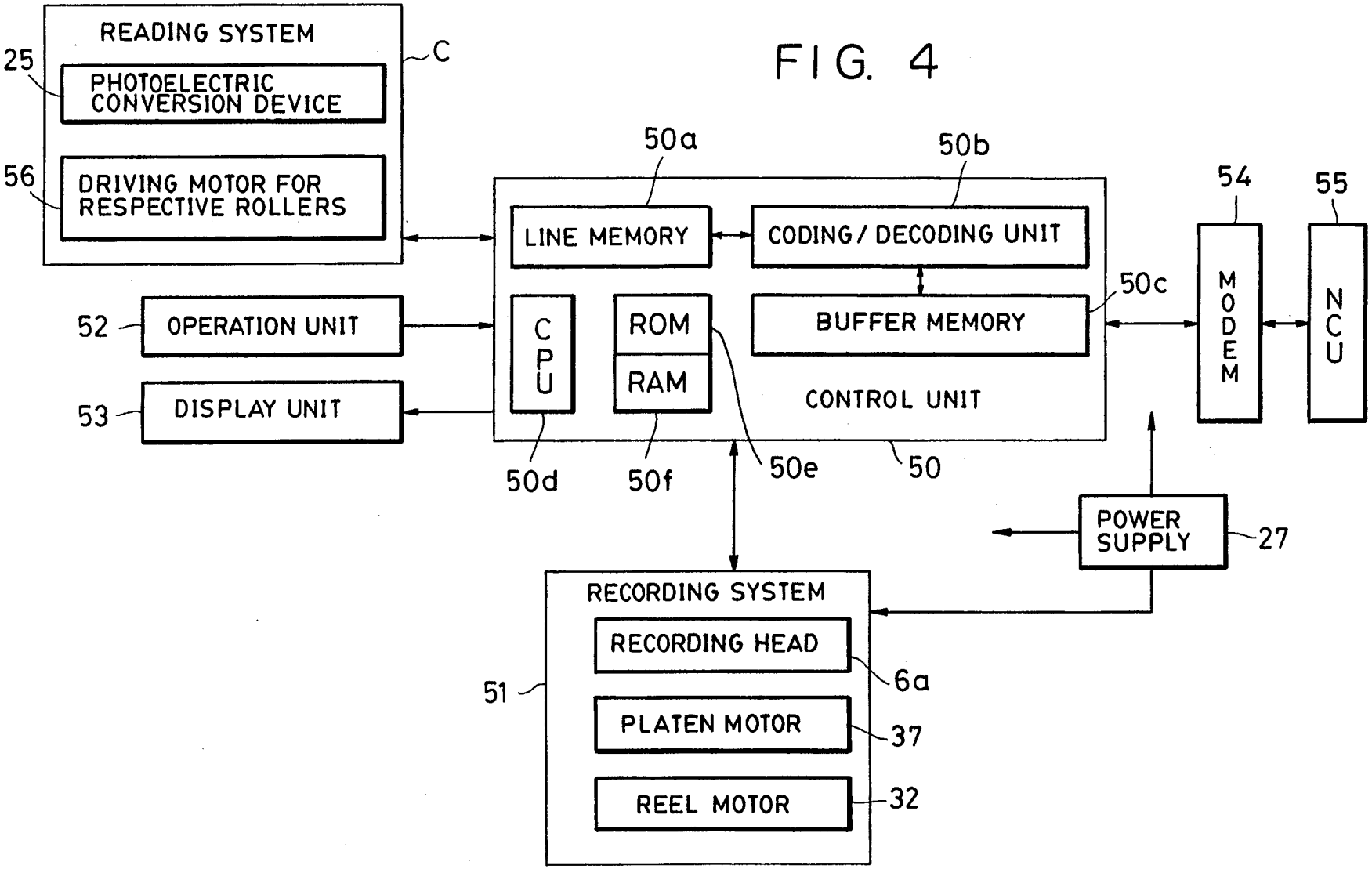
FIG. 4 is a block diagram of a control system of the recording apparatus of the invention.

A control system for controlling the drive of the apparatus is configured as shown in the block diagram of FIG. 4.

The specific configuration of the preferred embodiment will now be explained. In FIG, 4, the reading system C includes the above-described photoelectric conversion device 25 and a driving motor 56 for driving preliminary conveying roller 18a, pairs of conveying rollers 20a and 20b and the like. A line memory 50a within a control unit 50 stores image data for each line of an image. In the line memory 50a, image data for one line of the image from the reading system C is stored in transmission or a copying operation of the original 17, and data for one line of a decoded received image is stored in reception of image data.

Image recording is performed by outputting data stored in the line memory 50a to the recording head 6a. A coding/decoding unit 50b encodes image information to be transmitted by MH coding or the like, and also decodes received encoded image data to convert the data into image data. A buffer memory 50c stores encoded image data to be transmitted or which has been received. Each of these units in the control unit 50 is controlled by a central processing unit (CPU) 50d, such as a microprocessor or the like. The control unit 50 also includes a read-only memory (ROM) 50e for storing control programs for the CPU 50d and various kinds of data, a random access memory (RAM) 50f as a work area for the CPU for temporarily storing various kinds of data.

A recording system, which includes the above-described recording head 6a and motors (a reel driving motor 32 and a platen motor 37) to be described later, drives these components according to signals from the CPU 50d. An operation unit 52 includes keys for indicating various kinds of functions, such as start of transmission and the like, keys for inputting telephone numbers, and the like. A display unit 53 displays various functions provided in the operation unit 52, various states of the apparatus, and the like. There is also shown a modem (modulator-demodulator) 54. A network control unit (NCU) 55 controls communication between the apparatus and the network.

Next, an explanation will be provided of the mounting unit 5 in the recording apparatus B for mounting the cartridge A.

As shown in FIG. 3(A), positioning members 28 are symmetrically mounted at both sides of the recording cover 11. On the respective positioning members 28, there are provided hooked grooves 28a for anchoring the guide pins 4e of the cartridge A. U-grooves 28b and 28c are provided on the positioning member 28 to engage with the bearings 8, which are positioned on both ends of the reels 2 and 3. Near the end of the cover 11 opposite to the end at which hinge shaft 12 is positioned, there is provided anchoring leaf spring 29 for engaging anchoring projection 4n to secure cartridge A in position.

Figure 3B:
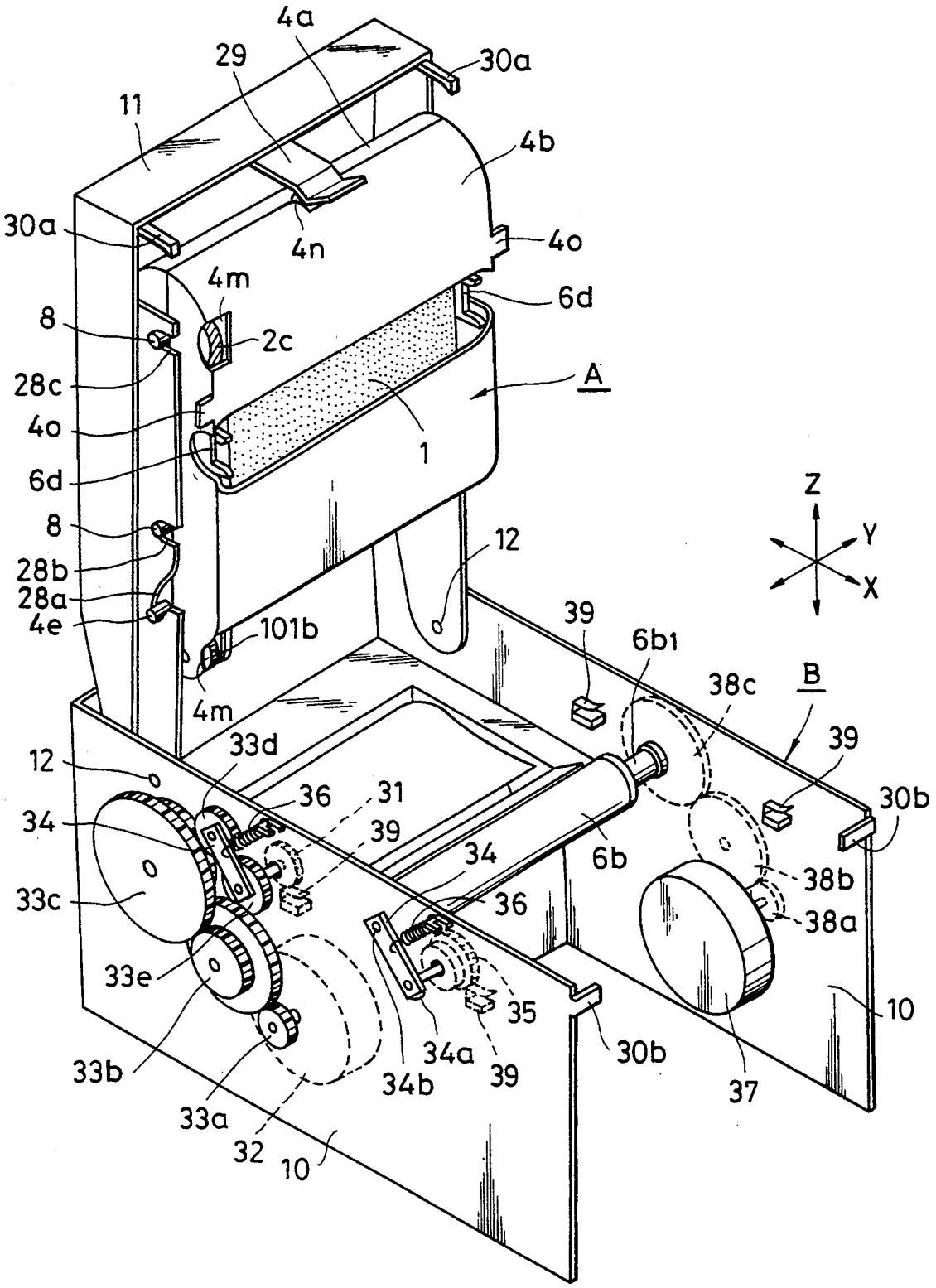

Accordingly, by fitting and anchoring the guide pins 4e of the cartridge A in the hooked grooves 28a and rotating the cartridge A around the guide pins 4e, as shown in FIG. 3(A), and by engaging the anchoring projection 4n with the anchoring spring 29, as shown in FIG. 3(B), the cartridge A is mounted on the recording cover 11. At this time, the bearings 8 are secured within the respective U-grooves 28b and 28c.

In this mounting operation, since each of the guide pins 4e and the U-grooves 4c and 4d fitted with the bearings 8 of the cartridge A are arranged on a straight line, the bearings 8 of the supply reel 2 and the takeup reel 3 are almost simultaneously positioned relative to the U-grooves 28b and 28c of the positioning members 28 when the cartridge A is rotated around the guide pins 4e. The bearings 8 are thereby securely positioned and fit relative to the U-grooves 28b and 28c of the positioning members Furthermore, by providing the guide pins 4e and the U-grooves 4c and 4d fit with the bearings 8 at the side of the first casing 4a and arranging each pair of these components on a straight line, and by also arranging each of the hooked grooves 28a and the U-grooves 28b and 28c provided in the members 28 for positioning the above-described components on a straight line, the bearings 8 are exactly positioned relative to the guide pins 4e. That is, according to the present embodiment, by only arranging each of the hooked grooves 28a and the U-grooves 28b and 28c on a straight line in each of the positioning members 28, high positional accuracy can be obtained when positioning the bearings 8.

Figure 5A:
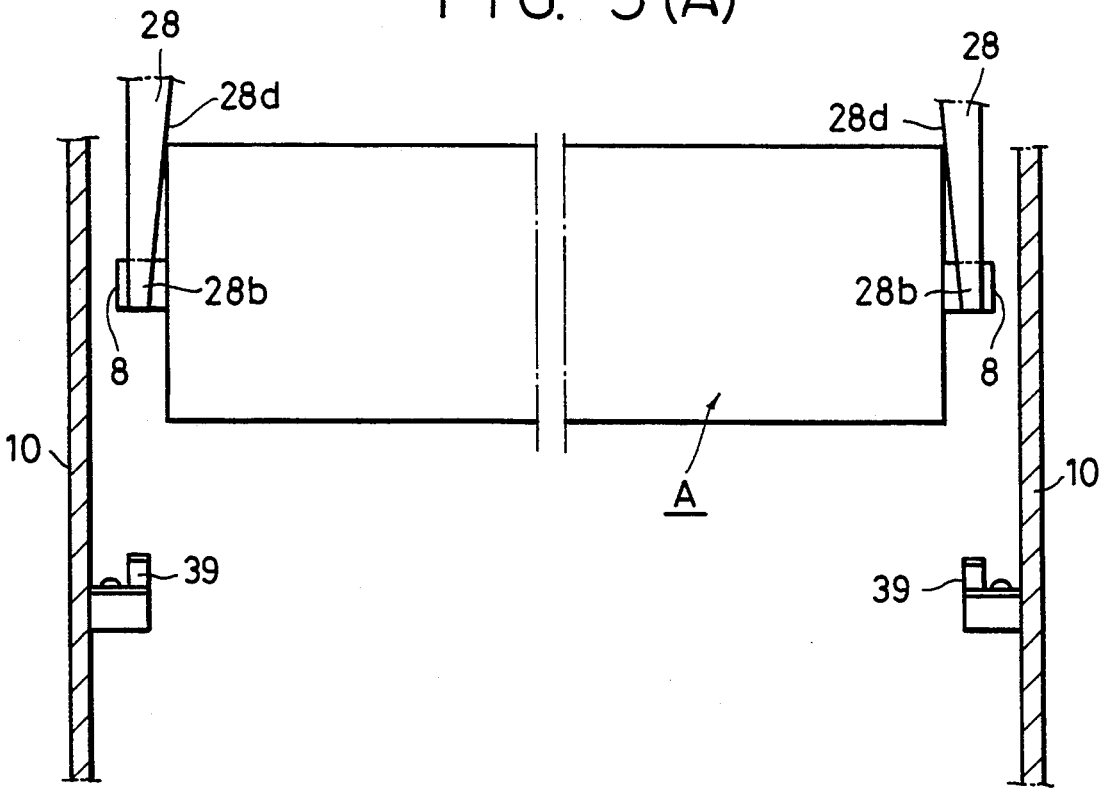
FIGS. 5(A) and 5(B) are cross-sectional views for explaining states in which the ink sheet cartridge is mounted on a positioning member and a recording cover is closed.

As shown in FIG. 5(A), the positioning members 28 of the present embodiment are configured so that their inner sides 28d are tapered, that is, the spacing between their inner sides is large at a lower position and is gradually narrowed toward an upper position. Accordingly, when the cartridge A is rotated around the guide pins 4e, the cartridge A is guided along the tapered inner sides. Hence, the cartridge A can be easily mounted, and backlash of the cartridge A in the direction of the reel shaft (the direction of arrow Y in FIG. 3(B)) after loading does not occur.

Figure 7:
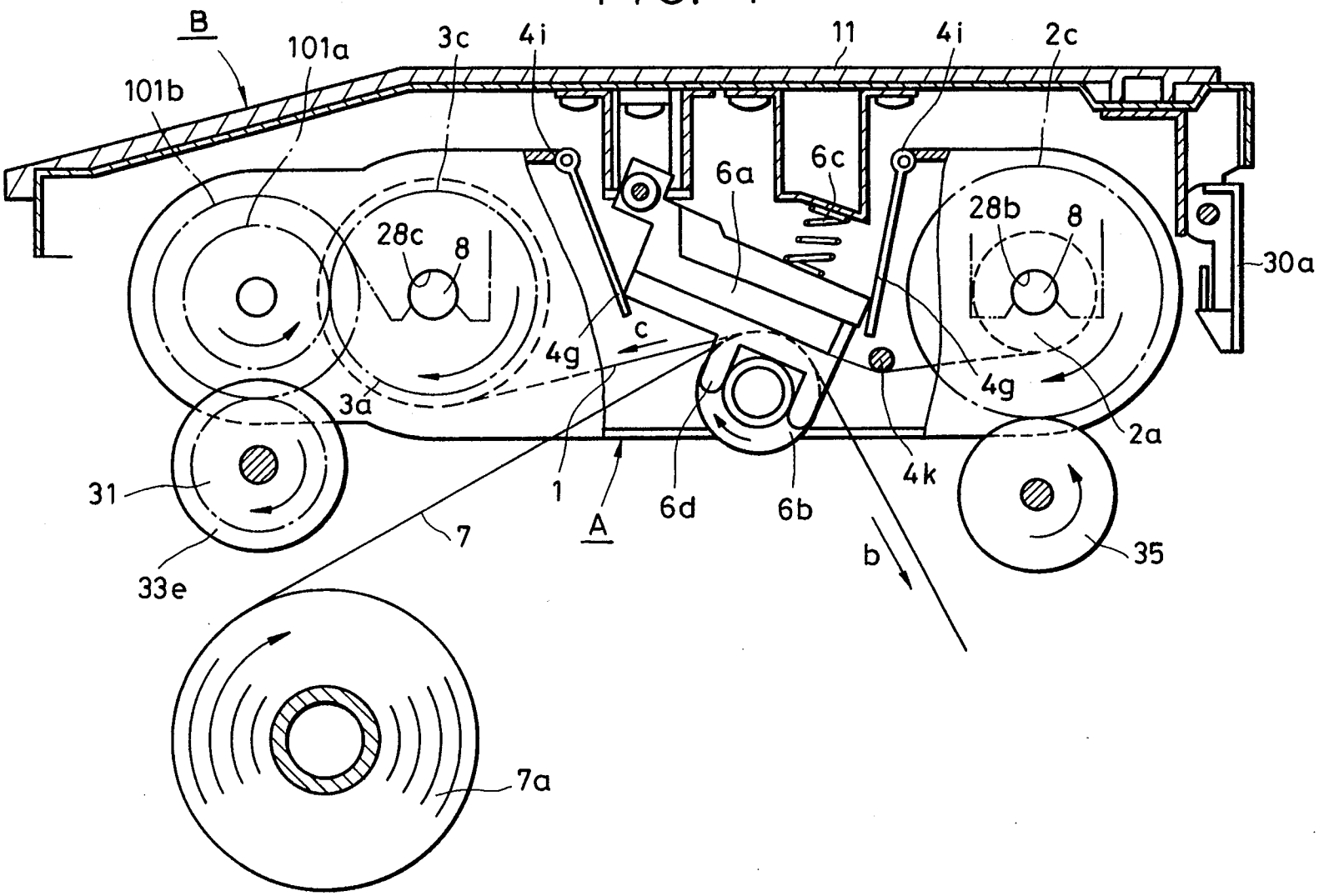
FIG. 7 is a cross-sectional view of the ink sheet cartridge while in a recording state.

As described above, when the cartridge A is mounted, the fork members 6d mounted on the recording head 6a push and open the covers 4g of the cartridge A against the energizing force of the torsion coil springs 4i, and the recording head 6a is thereby received within the cartridge A through the opening 4f of the cartridge A, as shown in FIG. 7. When the recording head 6a is received through the opening 4f, there is a certain distance between the guide pins 4e, which are provided at end portions of the cartridge A and become the center of rotation of the cartridge A. Hence, the size of the opening 4f can be the size of the recording head 6a which is the minimum size for receiving the recording head 6a. That is, it is possible to make the size of the opening 4f almost identical to the size of the recording head 6a, and hence to make the cartridge A more compact.

The energizing force of the covers 4g by the torsion coil springs 4i (the force urging the covers 4g to a closed state) must be a force which gives way to the pressing force when the recording head 6a is inserted and presses against the platen roller 6b. Accordingly, in the present embodiment, the pressing force of the recording head 6a against the platen roller 6b by the pressing spring 6c is set to about 150 gf/cm, while the energizing force of the covers 4g by the torsion coil springs 4iis set to about 60 gf/cm.

As described above, when the cartridge A is mounted, fork members 6d mounted en the recording head 6a automatically push and open covers 4g, and the recording head 6a is received within the cartridge A. Furthermore, since the covers 4g open from the center of the opening 4f by the pressure of the recording head 6a, the rotating radius of each cover 4g is small. Hence, it is possible to narrow the thickness of the cartridge A.

After cartridge A is mounted on the recording cover 11 as described above (the state of FIG. 3(B)), the cover 11 is closed, and hooks 30b of the main body 10 of the apparatus are anchored with hooks 30a of the recording cover 11. At this time, the reel gear 2c formed as one body with the supply reel 2 meshes with a slip clutch gear 35 mounted at the side of the main body 10 of the apparatus. The large gear 101b of the two-stage gear 101 is arranged so as to mesh with a driving force transmission gear 31 mounted at the side of the main body 10 of the apparatus. The small gear 101a of the two-stage gear 101 meshes with the reel gear 3c, which gear is formed as one body with the takeup reel 3, is arranged so as to mesh with a driving force transmission gear 31 mounted at the side of the main body 10 of the apparatus.

The operation of the above-described configuration will now be explained. As shown in FIG. 3(B), the reel driving motor 32 for rotatably driving the reel 3 is mounted at the side of the main body 10 of the recording apparatus B. A drive force from the motor 32 is transmitted to the driving force transmission gear 31 via a gear train 33a–33e. Gear 33e is mounted on an arm 34 rotatable around the gear shaft of gear 33d, and is configured as a so-called pendulum gear swingable around the circumference of the gear 33d while meshing with the gear 33d. The driving force transmission gear 31 is swingable as one body with the pendulum gear 33e, and, as shown in FIG. 7, the rotation force from the pendulum gear 33e is transmitted to the takeup reel 3 via the large gear 101b and the small gear 101a of the two-stage gear 101 and the reel gear 3c. Returning to FIG. 3(B), at the side of the main body 10 of the recording apparatus B, the shaft of the slip clutch gear 35 is fixed to an arm 34 rotatable around a center of rotation 34b with a screw 34a or the like.

In FIG. 3(B), there is shown a tension spring 36 for upwardly pulling the arm 34. A platen motor 37 rotates the platen roller 6b. The driving force of the motor 37 is transmitted to the platen roller 6b via a gear train 38a–38c.

Figure 6:
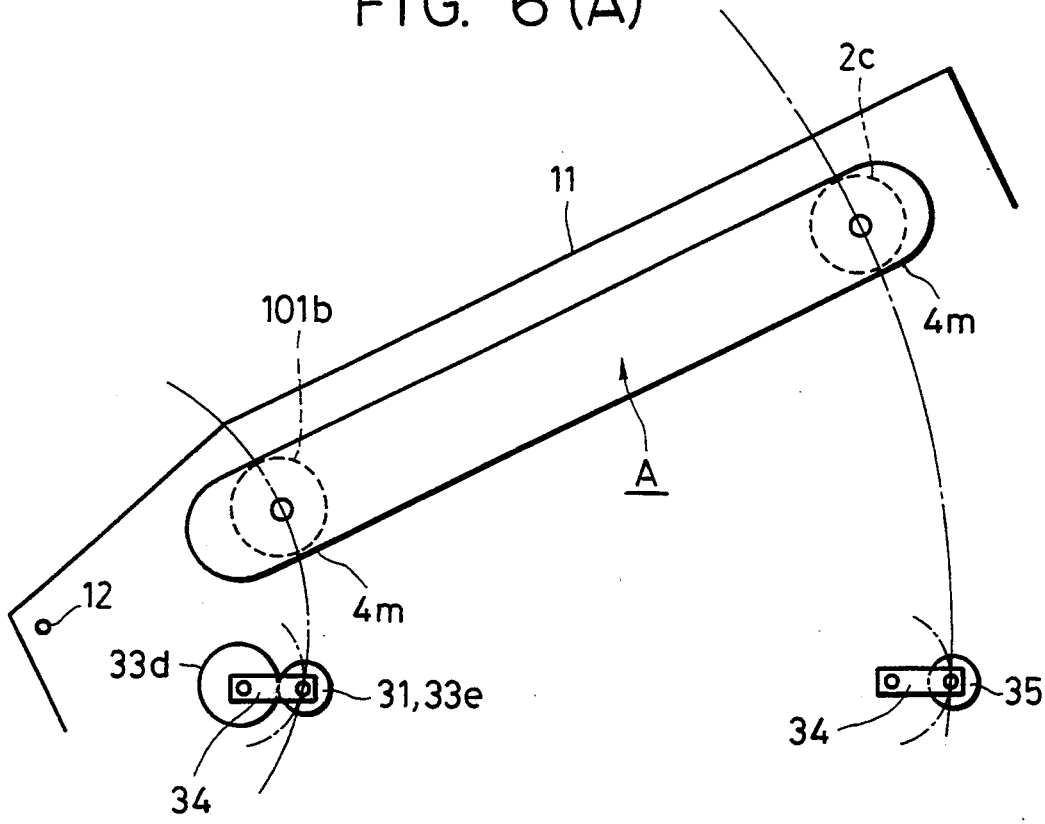
FIGS. 6(A) and 6(B) are diagrams for explaining the relationship between a two-stage gear and a pendulum gear when the recording cover is closed.
Figure 6:
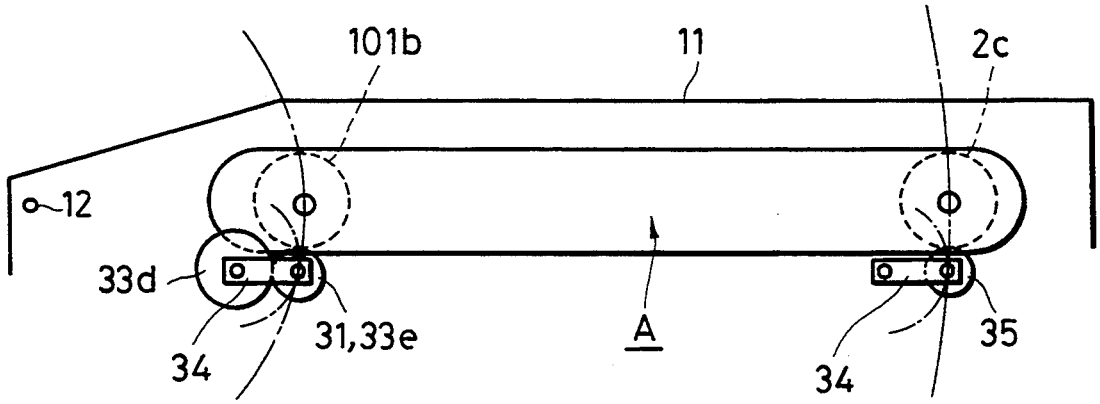

In such a configuration, when the recording cover 11 is closed, the reel gear 2c and the large gear 101b of the two-stage gear 101 exposed from the openings 4m of the cartridge A mesh with the slip clutch gear 35 and the driving force transmission gear 31, respectively. In the present embodiment, the openings 4m are provided so as to be situated on circles which are rotating loci of the reel gear 2c and the large gear 101b around the hinge shaft 12 of the recording cover 11, as shown in FIGS. 6(A) and 6(B). The slip clutch 35 and the driving force transmission gear 31 are also provided so as to be situated on the locus circles. Accordingly, when the recording cover 11 is closed, the gears 2c and 101b exposed through the openings 4m press and securely mesh with the slip clutch 35 and the driving force transmission gear 31, respectively. Even if the lead gear 33d connected to the motor 32 is in a locked state at this time, the pendulum gear 33e swinging as one body with the driving force transmission gear 31 smoothly swings around the circumference of the lead gear 33d. Hence, the recording cover 11 can be smoothly closed.

Figure 5B:
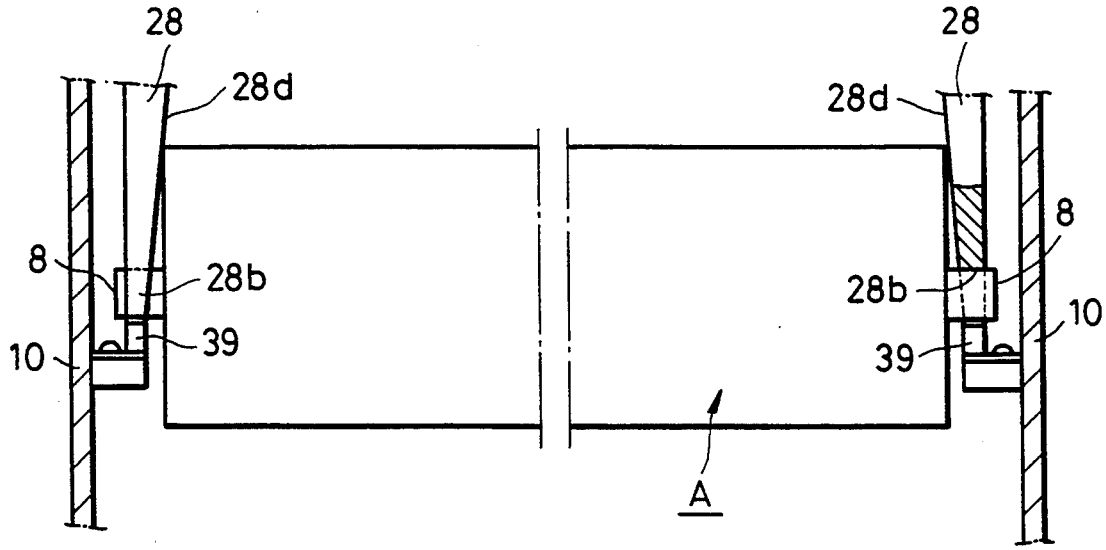

As shown in FIG. 3(B), at the side of the main body 10 of the apparatus, leaf springs 39, serving as pressing members, are mounted at positions facing the bearings 8 of the cartridge A as mounted on the recording cover 11. The bearings 8 are pressed into the U-grooves 28b and 28c of the positioning members 28 by the leaf springs 39. As shown in FIG. 5(B), the bearings 8 are thereby securely positioned in the upward direction (the direction of arrow Z in FIG. 3(B)). As shown in FIG. 5(B), the leaf springs 39 are mounted so as to coincide with the U-grooves 28b and 28c of the positioning members 28 in the direction of the reel shaft. If, for example, each of the leaf springs 39 and the positioning members 28 do not coincide with each other in the direction of the reel shaft, a torsional force is applied on the bearings 8, and hence a frictional force unnecessary for the rotation of the reels 2 and 3 is applied. In the present embodiment, however, such inconvenience does not occur according to the above-described configuration.

As described above, the bearings 8 are positioned in the U-grooves 28*b* and 28*c* of the positioning members 28, and the positioning operation when the cartridge A is mounted within the recording cover 11 and the positioning operations of the bearings 8 are performed independently from each other. That is, by directly positioning the bearings 8 in the recording apparatus B not through the cartridge A, it becomes possible to increase accuracy in parallelism between the reels 2 and 3 and the platen roller 6*b*, and the like. Furthermore, since there is leeway in the positioning of the bearing 8 in the cartridge A, the cartridge A does not require rigidity and accuracy, Hence, the cost of producing the cartridge A is lowered.

As shown in FIG. 7, in the present embodiment, when the recording cover 11 is closed, the area where the recording head 6*a* and the platen roller 6*b* are brought into contact is situated at near the center in the direction of the thickness of the cartridge A. If the pressed contact portion is situated at an upper portion within the cartridge A, the notches $4l_2$ for receiving the shaft of the platen roller 6*b*, as shown in FIG. 1, must be deep, and hence the strength of the second casing 4*b* is lessened. To the contrary, if the pressed contact portion is situated at a lower portion within the cartridge A, the opening 4*f* for receiving the recording head 6*a* and the fork members 6*d* must be large. In the present embodiment, however, since the pressed contact portion is situated at near the center, the strength of the second casing 4*b* is not weakened, and the opening 4*f* can be made in the minimum size required.

Next, a recording operation by the recording apparatus B mounting the cartridge A will be explained.

During recording, the platen motor 37 and the reel driving motor 32 are driven in accordance with a control signal from the control unit 50 in response to an operation of the operation unit 52 by the operator. When the platen motor 37 is driven, the platen roller 6*b* rotates clockwise (in the direction of arrow "a" in FIG. 7) to convey the recording sheet 7 in the direction of arrow b in FIG. 7. 0n the other hand, the ink sheet 1 is conveyed in the direction of arrow c by the reel driving motor 32. In synchronism therewith, the heating elements $6a_1$ of the recording head 6*a* are heated in accordance with image signals according to control signals from the control unit 50, and the ink sheet 1 is thereby heated in the shape of an image pattern. As described above, the recording head 6*a* is controlled by data output from the buffer memory 50*c* which stores image data for one line from the reading system C of the apparatus in a copy mode and data for one line of decoded received image data in a reception mode. Ink fused by this heating is transferred to the recording sheet 7.

By thus making the conveying directions of the recording sheet 7 and the ink sheet 1 reverse to each other, the direction in which an image is sequentially recorded in the longitudinal direction of the recording sheet 7 (the direction of arrow c which is reverse to the conveying direction of the recording sheet 7) coincides with the conveying direction of the ink sheet 1. The gear train 33*a*–33*e*, 31, 101*b*, 101*a* and 3*c* of the conveying system for the ink sheet 1 and the gear train 38*a*–38*c* of the conveying system for the recording sheet 7 are configured so that the conveying speed $V_p$ of the recording sheet 7 is $V_p = -n \cdot V_1$ ($V_1$ is the conveying speed of the ink sheet 1, and the sign "−" indicates the conveying direction is the reverse).

In the present embodiment, the conveying driving system for the recording sheet 7 is provided at the side of the main body 10, and its reduction ratio is fixed. In the conveying driving system for the ink sheet 1, the gear train 33*a*–33*e* and the driving force transmission gear 31 are provided at the side of the main body 10, and the two-stage gear 101 and the takeup-reel gear 3*c* are housed in the cartridge A. Accordingly, the conveying speed $V_p$ of the recording sheet 7 is constant in the apparatus, while the conveying speed $V_1 = V_p/n$ of the ink sheet 1 can be changed by changing the combination of the numbers of teeth of the gear 101*a* and the takeup-reel gear 3*c*.

Consequently, a cartridge $A_1$ incorporating a multiink sheet with, for example, n=3 for multiprint, is adjusted when shipped from a factory so that it receives a driving force from the side of the main body of the apparatus when it is mounted on the main body of the apparatus, and so that it can wind the ink sheet at a speed (amount) corresponding to the multiink sheet with n=3 by reducing the driving force. That is, when the cartridge is shipped from the factory, the combination (gear ratio) of the numbers of teeth on the gear 101*a*, serving as a reduction gear, and the takeup-reel gear 3*c*, is selected in accordance with the number n of the ink sheet 1 to be housed within the cartridge A, and the gears 101*a* and 3*c* conforming to the combination are assembled within the cartridge.

Similarly, for a cartridge $A_2$ incorporating a multiink sheet with n=5, gears 101*a* and 3*c*, having a gear ratio conforming to n=5, are assembled within the cartridge when the cartridge is shipped from a factory, so as to be able to wind the ink sheet with a speed (amount) corresponding to the multiink sheet with n=5. Gear ratios between the gears 101*a* and 3*c* in accordance with respective values of n are shown in FIG. 9, which will be described later. Accordingly, in the present embodiment, even if the above-described cartridges $A_1$ and $A_2$ are mounted in a common facsimile, each ink sheet can be wound with a speed (amount) corresponding to the value n for the respective built-in ink sheet.

FIG. 9 is a diagram showing the relationship between the combination of the numbers of teeth of the gears 101*a* and the takeup-reel gear 3*c*, and the conveying speed of the ink sheet 1 relative to the recording sheet 7.

Although the number of teeth of the large gear 101*b* of the cartridge A cannot be changed because it meshes with the driving force transmission gear 31 of the main body of the apparatus, by selecting the respective numbers of teeth so as to maintain the sum of the numbers of teeth of the small gear 101*a* and the takeup-reel gear 3*c* constant, various n-time multiink sheets can be mounted and used while a common receptacle 4 of the cartridge A is used. As is apparent from FIG. 9, the diameter of the small gear 101*a* of the two-stage gear 101 has the maximum value when n is smallest. By making the number of teeth of the small gear 101*a* equal to or smaller than the number of teeth of the constant size gear 101*b* of the two-stage gear 101 when initially n=3, it is possible to prevent the problem where the small gear 101*a* cannot be received within the receptable when n becomes very large.

Since the number of teeth of the takeup-reel gear 3*c* increases as n becomes larger, there may arise the situation where the gear 3c is too large to be received within the receptacle. In order to prevent such an occurrence, a number of teeth capable of being received within the receptacle is selected previously assuming a large value of n (for example, n=10), as shown in FIG. 9. Even if an ink sheet having a much larger value of n (for example, n=20, 30 or the like) is produced, the gear 3c can be received within the receptacle 4 making the reduction ratio between the gear 101a and the takeup-reel gear 3c large by making the module of teeth small.

Although, in the present embodiment, an explanation has been provided of a case in which n increases, the present invention is not limited thereto, but is also applicable even to a case in which n decreases. In such a case, the gears may be configured so that the speed is increased by properly selecting the gear ratio.

According to the ink sheet cartridge having the configuration as described above, by changing the gear ratio in accordance with the value n of the ink sheet incorporated within the cartridge, it is possible to change the conveying ratio of the ink sheet relative to the conveying amount of the recording sheet. That is, it is possible to change the conveying speed (amount) of the ink sheet relative to the conveying speed (amount) of the recording sheet. Furthermore, according to the recording apparatus of the above-described embodiment, by mounting the ink sheet cartridge, recording can be performed by arbitrary multiprint in accordance with the value n of the ink sheet incorporated within the cartridge.

Figure 8:
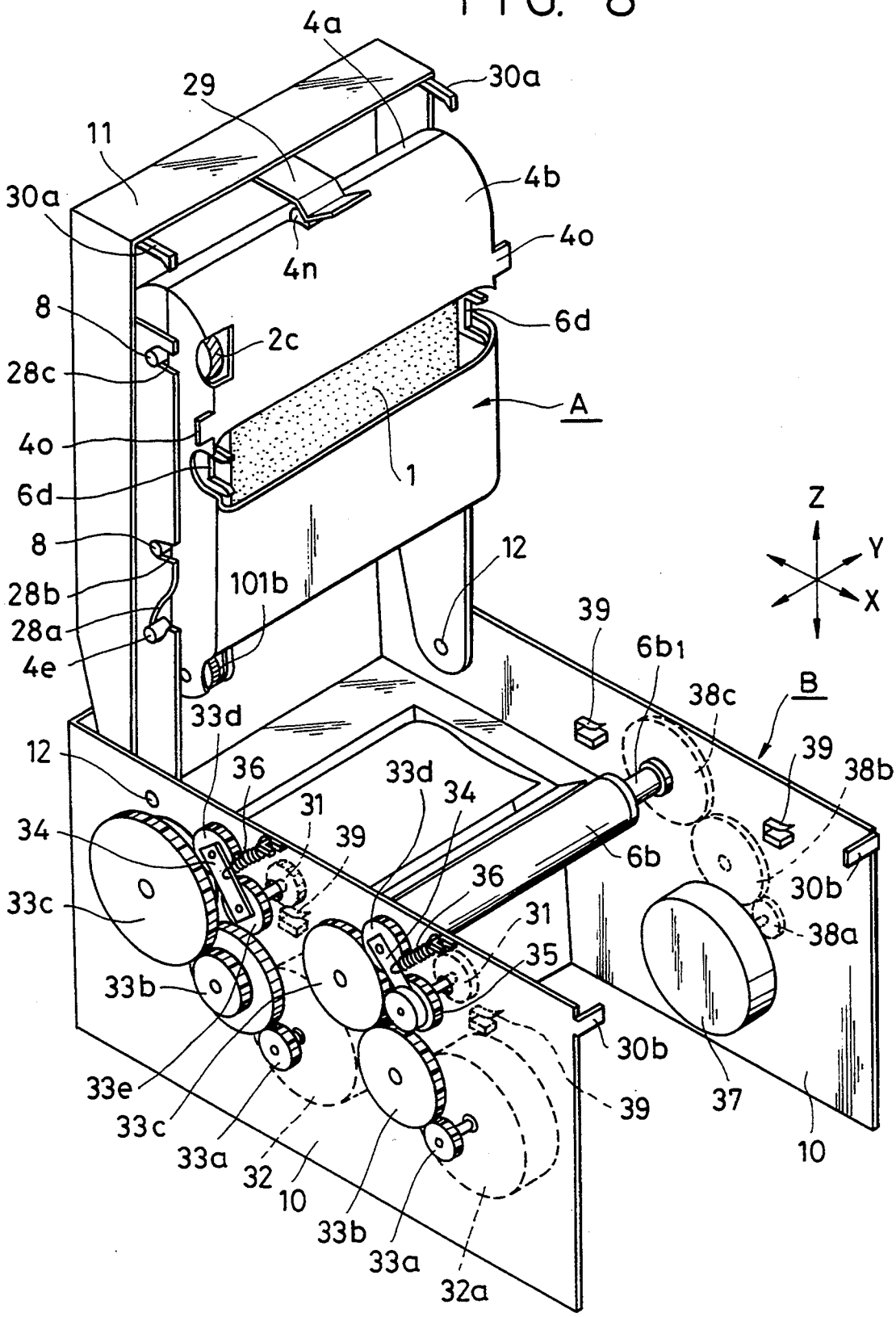
FIG. 8 is a perspective view of the driving system for an ink sheet when the ink sheet and a recording sheet have an identical moving direction.

Although, in the present embodiment, recording is performed reversing the conveying direction of the ink sheet 1 from the conveying direction of the recording sheet 7, recording may also be performed using the same conveying direction for the recording sheet and the ink sheet. In such a case, in the cartridge A shown in FIG. 1, a component indicated by numeral 2 is a takeup roll, and a component indicated by numeral 3 is a supply roll, other components being invariable. At the side of the main body of the apparatus, the conveying speed of the ink sheet 1 is determined by the reel motor 32 at the supply side, as shown in FIG. 8. In the present case, a reel motor 32a may be provided at the winding side in order to wind the ink sheet 1 via the slip clutch gear 35.

As explained above, according to the present embodiment, by providing a pair of reduction gears in an ink sheet cartridge housing a multiink sheet, it is possible to perform the movement of the ink sheet suitable for n-time multiprint.

Figure 10:
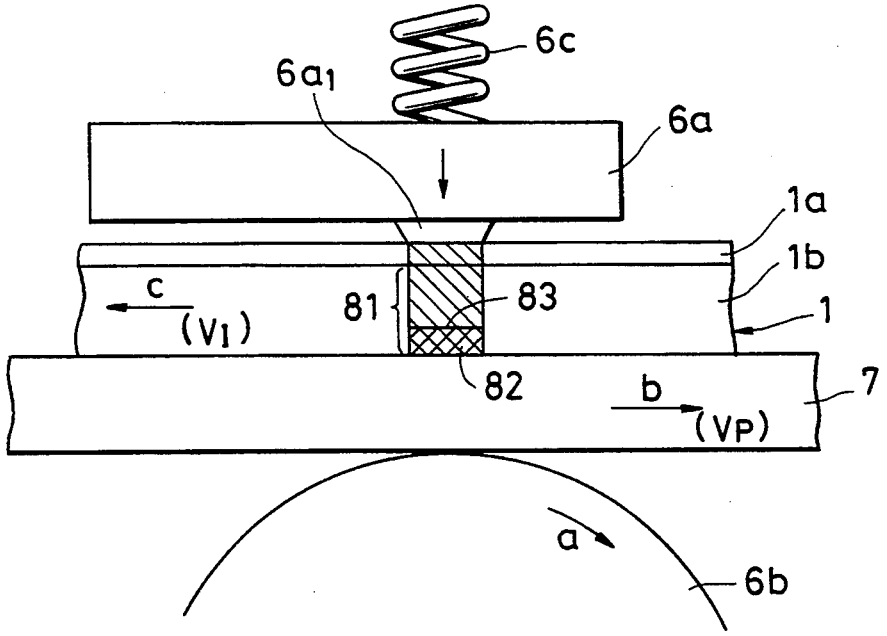
FIG. 10 is a cross-sectional view of a multiprint ink sheet while at the recording position in the invention.

FIG. 10 is a diagram showing a state of an image recording operation when an image is recorded when the moving directions of the recording paper 7 and the ink sheet 1 are reverse to each other in the above-described embodiment.

As shown in FIG. 10, the recording paper 7 and the ink sheet 1 are situated between the platen roller 6b and the thermal print head 6a. The thermal print head 6a is pressed against the platen roller 6b with a predetermined pressure by the spring 6c. The recording paper 7 is moved in the direction of arrow b at a speed $V_p$ by the rotation of the platen roller 6b. On the other hand, the ink sheet 1 is moved in the direction of arrow c at a speed $V_1$ by the rotation of the reel motor 32.

If the heating resistor $6a_1$ of the thermal print head 6a is now heated by passing current therethrough from the power supply 27, the portion 81 indicated by hatching of the ink sheet 1 is heated. In FIG. 10, the portion indicated by numeral 1a represents a base film of the ink sheet 1, and the portion indicated by numeral 1b represents an ink layer of the ink sheet 1. The ink in the ink layer 81 heated by passing current through the heating resistor $6a_1$ fuses, and a portion 82 of the ink layer is transferred to the recording paper 7. The portion 82 of the ink layer to be transferred corresponds to about 1/n of the ink layer 81.

In the transfer operation, it is necessary to produce a shearing force for the ink at a boundary 83 in the ink layer 1b in order to transfer only the portion 82 to the recording paper 7. The shearing force changes, however, with the temperature of the ink layer, and tends to decrease as the temperature of the ink layer is higher. The shearing force within the ink layer increases if the heating time for the ink sheet 1 is shortened. Accordingly, if the relative speed between the ink sheet 1 and the recording sheet 7 is increased, thereby increasing the shearing force, the ink layer to be transferred can be securely peeled from the ink sheet 1.

In the present embodiment, since the heating time for the thermal head 6a in the facsimile is as short as about 0.6 ms (milliseconds), the relative speed between the ink sheet 1 and the recording paper 7 is increased by reversing the moving directions of the ink sheet 1 and the recording paper 7 from each other.

Next, an explanation will be provided of the configuration of the ink sheet used in the present embodiment.

Figure 11:
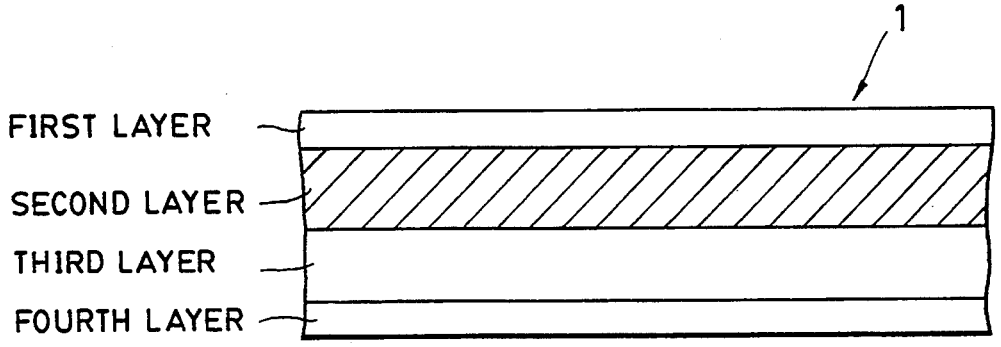
FIG. 11 is a cross-sectional view of a multiink sheet useful in the invention.

FIG. 11 is a cross-sectional view of a multiprint ink sheet useful in the present embodiment, and shows an example in which the sheet is made of four layers.

A second layer is a base film, serving as a support for the ink sheet 1, In the case of multiprint, since thermal energy is applied several times on an identical position, it is advantageous to use an aromatic polyamide film or capacitor paper having excellent heat-resistant property as the base film, However, a conventional polyester film may also be used, In consideration of the role of the base film as a medium, from the viewpoint of print quality it is more advantageous to use a film as thin as possible. A thickness of 3–8 μm is desirable from the viewpoint of strength, A third layer is an ink layer including ink in an amount capable of performing n-time transfer operations onto recording paper (recording sheets). Main constituents of the third layer are resin, such as EVA or the like, serving as an adhesive, carbon black and nigrosine dyes for coloring, carnauba wax, paraffin wax or the like, serving as a binding material, and the like, which are mixed so as to be able to resist against n-time uses at an identical position. It is desirable that the coated amount of the above-described constituents is 4–8 g/m$^2$, but may be arbitrarily selected, since the sensitivity and density of the layer differs according to the coated amount.

A fourth layer, which is a portion not performing recording, is a top coating layer for preventing the third layer from being transferred by pressure to the recording paper, and is made of transparent wax and the like. Only the transparent fourth layer is transferred by pressure to the recording paper, and hence staining of the surface of the recording paper is prevented. A first layer is a heat-resistant coating layer for protecting the base film, i.e., the second layer, from the heat produced by the thermal print head 6a. This layer is suitable for multiprint in which there is the possibility of thermal energy for n lines being applied on an identical position (for example, when black information continues). However, one may select whether or not the first layer is used. The first layer is also effective for a base film having relatively low heat-resistant property, such as a polyester film.

The configuration of the ink sheet 1 is not limited to that of the present embodiment, but may include a sheet made, for example, of a base layer and a porous ink retaining layer including ink provided on one surface of the base layer. Furthermore, a sheet made of a base film provided with a heat-resistant ink layer having a fine porous network structure thereon, within which ink is included, may also be used. As the material for the base film, a film or paper made, for example, of polyamide, polyethylene, polyester, polyvinyl chloride, triacetylcellulose, nylon or the like may also be used. As the material for the heat-resistant coating layer, though not always necessary, silicone resin, epoxy resin, fluororesin, nitrocellulose or the like may be used.

As an example of the ink sheet having thermosublimable ink, an ink sheet made of a base material consisting of a film of polyethylene terephthalate, polyethylene naphthalate or aromatic polyamide or the like provided with a color-material layer including spacer particles made of guanamine-type resin and fluorine-type resin, and dyes thereon may be used.

The heating method in the thermal transfer printer is not limited to the above-described thermal print head method using a thermal print head, but a current passing method or a laser transfer method may, for example, be used.

Although in the present embodiment an explanation has been provided illustrating a case in which a thermal line head is used, the present invention is not limited thereto, but may also use a so-called serial-type thermal transfer printer. Moreover, although in the present embodiment an explanation has been provided illustrating the case in which a facsimile is adopted as the recording apparatus, a copier combining a printer, a reader and the like as an image output terminal of an information processing apparatus, such as a computer or the like, an electronic typewriter, a word processor or the like may also be adopted as the recording apparatus of the present invention.

The recording medium is not limited to recording paper, but cloth, a plastic sheet or the like may, for example, be used, provided that ink can be transferred thereto.

The method for mounting the ink sheet cartridge is not limited to that shown in the above-described embodiment. The ink sheet 1 unwound around the supply reel 2 may be completely wound around the takeup reel 3, and the cartridge A may then be removed from the main body 10 of the apparatus. Subsequently, the cartridge A may be mounted in the main body 10 with reversing the right and left sides. According to this embodiment, the subsequent recording is performed while unwinding the ink sheet 1 wound around the takeup reel 3 around the supply reel 2.

As explained above, according to the present invention, it becomes possible to provide an ink cartridge capable of performing recording without changing the control of the main body of a recording apparatus irrespective of any ink sheet for multiprint with any magnification being housed. Furthermore, a recording apparatus mounting the inventive ink cartridge can perform arbitrary multiprint without changing its mechanism and control.

What is claimed is:

1. An ink sheet cartridge mountable on a recording apparatus, comprising:

a frame for storing an ink sheet, said ink sheet being of a kind suitable for multiprint recording;

a supply reel for unwinding said ink sheet for recording;

a takeup reel for winding said ink sheet that is unwound from said supply reel; and at least one reduction gear which transmits a driving force from said recording apparatus to said takeup reel, said at least one reduction gear providing a reduction ratio which determines a conveying amount of said ink sheet so as to convey said ink sheet from said supply reel to said takeup reel at a speed corresponding to said kind of said ink sheet, wherein said ink sheet cartridge is used to record on a recording medium which is conveyed at a constant velocity and said at least one reduction gear comprises at least a two-stage gear.

2. An ink sheet cartridge according to claim 1, wherein said two-stage reduction gear transmits the driving force to said takeup reel at a reduced driving speed from a side of said recording apparatus.

3. An ink sheet cartridge mountable on a recording apparatus, comprising:

a frame for storing an ink sheet, said ink sheet being of a kind suitable for multiprint recording;

a supply reel for unwinding an ink sheet for recording;

a takeup reel for winding said ink sheet that is unwound from said supply reel; and driving force transmission means for transmitting a driving force from said recording apparatus to said takeup reel so as to convey said ink sheet from said supply reel to said takeup reel at a speed corresponding to said kind of said ink sheet, wherein said ink sheet cartridge is used to record on a recording medium which is conveyed at a constant velocity, and wherein said driving force transmission means includes a two-stage gear consisting of a large gear for meshing with a gear provided at said recording apparatus and a small gear meshing with a gear provided at the takeup reel for said ink sheet cartridge, said two-stage gear formed as a unitary body.

4. A recording apparatus for recording on a recording medium, comprising:

a mounting unit;

an ink sheet cartridge mounted on said mounting unit, said cartridge comprising a frame for storing an ink sheet, said ink sheet being of a kind suitable for multiprint recording, a supply reel for unwinding said ink sheet for recording, a takeup reel for winding said ink sheet, and at least one reduction gear which transmits a driving force from said recording apparatus to said takeup reel, said at least one reduction gear providing a reduction ratio which determines a conveying amount of said ink sheet so as to convey said ink sheet from said supply reel to said takeup reel at a moving speed corresponding to said kind of said ink sheet;

recording means for recording onto said recording medium with said ink sheet included in said ink sheet cartridge mounted in said mounting unit;

driving means for transmitting the driving force to said at least one reduction gear included in said ink sheet cartridge mounted in said mounting unit; and conveying means for conveying said recording medium so that during recording said recording medium is conveyed with a constant velocity, wherein and said at least one reduction gear comprises at least a two-stage gear.

5. A recording apparatus according to claim 4, wherein said two-stage reduction gear transmits at a reduced driving speed the driving force to said takeup reel from said driving means.

6. A recording apparatus according to claim 4, wherein said recording apparatus is a facsimile device including reading means and communication means.

7. A recording apparatus according to claim 4, wherein said recording means includes a thermal print head having a plurality of heating elements.

8. A recording apparatus for recording on a recording medium, comprising:

a mounting unit;

an ink sheet cartridge mounted in said mounting unit, said cartridge comprising a frame for storing an ink sheet, said ink sheet being of a kind suitable for multiprint recording, a supply reel for unwinding said ink sheet for recording, a takeup reel for winding said ink sheet, and driving force transmission means for transmitting a driving force from said recording apparatus to said takeup reel so as to convey said ink sheet from said supply reel to said takeup reel at a moving speed corresponding to said kind of said ink sheet;

recording means for recording onto said recording medium with said ink sheet included in said ink sheet cartridge mounted in said mounting unit;

driving means for transmitting the driving force to said driving force transmission means included in said ink sheet cartridge mounted in said mounting unit; and conveying means for conveying said recording medium so that during recording said recording medium is conveyed with a constant velocity, wherein said driving means includes a gear and said driving force transmission means includes a two-stage gear consisting of a large gear for meshing with the gear included in said driving means and a small gear for meshing with a gear provided at the takeup reel in said ink sheet cartridge, said two-stage gear formed as a unitary body.

9. A recording apparatus according to claim 8, wherein said gear included in said driving means is a displaceable swinging gear.

10. An ink sheet cartridge mountable on a recording apparatus, said apparatus having an ink sheet for multiprint recording provided in a frame, said cartridge comprising:

a takeup reel for winding said ink sheet;

a supply reel for unwinding said ink sheet for recording; and at least one reduction gear for receiving a driving force for moving said ink sheet and for transmitting a reduced amount of said driving force to said takeup reel to move said ink sheet, said at least one reduction gear providing a reduction ratio which determines a conveying amount of said ink sheet, wherein said ink sheet cartridge is used to record on a recording medium which is conveyed at a constant velocity and said at least one reduction gear comprises at least a two-stage gear.

11. An ink sheet cartridge mountable on a recording apparatus, said cartridge having an ink sheet for multiprint recording provided in a frame, said cartridge comprising:

a takeup reel for winding said ink sheet;

a supply reel for unwinding said ink sheet for recording; and at least one reduction gear for receiving a driving force for moving said ink sheet and for transmitting a reduced amount of said driving force to said ink sheet;

wherein said ink sheet cartridge is used to record on a recording medium which is conveyed at a constant velocity, and wherein said at least one reduction gear comprises at least one two-stage gear, a number of teeth of one gear of which is fixed so as to be engageable with a driving force transmission means of the recording apparatus, and a second gear having a reduction ratio with another gear of said two-stage gear, the reduction ratio corresponding to the type of the ink sheet incorporated between the reels.

12. A recording apparatus for recording an image on a recording medium, said recording apparatus comprising:

a mounting unit for mounting an ink sheet cartridge using an ink sheet for multiprint recording, said ink sheet cartridge comprising a takeup reel for winding said ink sheet, a supply reel for unwinding said ink sheet for recording, and at least one reduction gear for receiving a driving force for moving said ink sheet, and for transmitting an amount of said driving force to said takeup reel to move said ink sheet, said at least one reduction gear providing a reduction ratio which determines a conveying amount of said ink sheet;

driving force transmission means engageable with said at least one reduction gear when said ink sheet cartridge is mounted in said mounting unit, for transmitting the driving force to said at least one reduction gear; and recording means for recording an image onto said recording medium with the ink sheet included in said ink sheet cartridge when said ink sheet cartridge is mounted, wherein during recording said recording medium is conveyed at a constant velocity and said at least one reduction gear comprises at least a two-stage gear.

13. A recording apparatus according to claim 12, wherein said recording means includes a thermal print head with a plurality of heating elements.

14. A recording apparatus according to claim 12, wherein said recording apparatus is a facsimile device including reading means and communication means.

15. A recording apparatus for recording an image on a recording medium, said recording apparatus comprising:

a mounting unit for mounting an ink sheet cartridge using an ink sheet for multiprint recording, said ink sheet cartridge comprising a takeup reel for winding said ink sheet, a supply reel for unwinding said ink sheet for recording, and at least one reduction gear for receiving a driving force for moving said ink sheet, and for transmitting an amount of said driving force to said ink;

driving force transmission means engageable with said at least one reduction gear when said ink sheet cartridge is mounted in said mounting unit, for transmitting the driving force to said at least one reduction gear; and recording means for recording an image onto said recording medium with the ink sheet included in said ink sheet cartridge when said ink sheet cartridge is mounted, wherein during recording said recording medium is conveyed at a constant velocity, and wherein said at least one reduction gear comprises at least one two-stage gear, a number of teeth of one gear of which is fixed so as to be engageable with said driving force transmission means of the recording apparatus, and a second gear having a reduction ratio with another gear of said two-stage gear, the reduction ratio corresponding to the type of the ink sheet incorporated between the reels.

16. A method for varying a conveying speed of an ink sheet, said ink sheet being housed in an ink sheet cartridge used for a recording apparatus to perform thermal transfer recording on a recording sheet conveyed with a constant conveying speed, said ink sheet having an ink supporting member with an ink layer able to perform said thermal transfer recording, said method comprising the steps of:

providing a first gear having a number of teeth;

providing a second gear having a number of teeth;

selecting the number of teeth of the first gear and the number of teeth of the second gear so that a sum of the number of teeth of the first gear and the number of teeth of the second gear is constant, a winding speed of said ink sheet corresponding to a predetermined number of times of thermal transfer recording in a direction of a thickness of the ink layer of said ink sheet;

driving the second gear with a driving force from said recording apparatus;

engaging the second gear with the first gear;

transmitting said driving force from the second gear to the first gear; and winding said ink sheet with the first gear.

17. A method according to claim 16, wherein said ink sheet is of a kind suitable for multiprint recording.

18. A method according to claim 16, wherein said driving force is transmitted to the first gear in said transmitting step at a reduced driving speed from a side of said recording apparatus.

19. A method according to claim 16, wherein said driving step comprises applying said driving force to the second gear using a displaceable swinging gear.

20. A method according to claim 16, wherein said recording apparatus is a facsimile device including receiving means for receiving external image information.

21. A method according to claim 16, wherein said recording apparatus includes a thermal print head having a plurality of heating elements.

22. A method according to claim 16, wherein the first gear and the second gear are housed in the ink sheet cartridge.

23. A method for varying a conveying speed of an ink sheet, said ink sheet being housed in an ink sheet cartridge used for a recording apparatus to perform thermal transfer recording on a recording sheet conveyed with a constant conveying speed, said ink sheet having an ink supporting member with an ink layer able to perform said thermal transfer recording, said method comprising the steps of:

providing a first gear having a number of teeth;

providing a second gear having a number of teeth;

providing a third gear, the second gear and the third gear being formed as a unitary body;

selecting the number of teeth of the first gear and the number of teeth of the second gear so that a sum of the number of teeth of the first gear and the number of teeth of the second gear is constant, a winding speed of said ink sheet corresponding to a predetermined number of times of thermal transfer recording in a direction of a thickness of the ink layer of said ink sheet;

driving the third gear with a driving force from said recording apparatus;

engaging the second gear with the first gear;

transmitting said driving force from the second gear to the first gear; and winding said ink sheet with the first gear.

24. A method according to claim 23, wherein said ink sheet is of a kind suitable for multiprint recording.

25. A method according to claim 23, wherein said driving force is transmitted to the first gear in said transmitting step at a reduced driving speed from a side of said recording apparatus.

26. A method according to claim 23, wherein said driving step comprises applying said driving force to the third gear using a displaceable swinging gear.

27. A method according to claim 23, wherein said recording apparatus is a facsimile device including receiving means for receiving external image information.

28. A method according to claim 23, wherein said recording apparatus includes a thermal print head having a plurality of heating elements.

29. A method according to claim 23, wherein the first gear and the second gear are housed in the ink sheet cartridge.

* * * * *

UNITED STATES PATENT AND TRADEMARK OFFICE

CERTIFICATE OF CORRECTION

PATENT NO. : 5,451,996

DATED : September 19, 1995

INVENTOR(S) : TAKASHI AWAI, ET AL.

It is certified that error appears in the above-identified patent and that said Letters Patent is hereby corrected as shown below:

COLUMN 1

Line 35, "sheet)," should read --sheet).--.
Line 49, "sheets" should read --sheet,--.

COLUMN 3

Line 32, "long sheet" should read --long side--.

COLUMN 6

Line 20, "data," should read --data, and--.

COLUMN 7

Line 2, "fit" should read --fitted--.
Line 50, "4iis" should read --4i is--.

COLUMN 9

Line 46, "0n" should read --On--.

COLUMN 10

Line 65, "receptable" should read --receptacle--.

COLUMN 12

Line 33, "sheet 1," should read --sheet 1.--.
Line 42, "strength," should read --strength.--.

UNITED STATES PATENT AND TRADEMARK OFFICE

CERTIFICATE OF CORRECTION

PATENT NO. : 5,451,996

DATED : September 19, 1995

INVENTOR(S) : TAKASHI AWAI, ET AL.

It is certified that error appears in the above-identified patent and that said Letters Patent is hereby corrected as shown below:

COLUMN 15

Line 4, "and" should be deleted.

COLUMN 16

Line 65, "ink;" should read --ink sheet;--.

Signed and Sealed this

Twenty-first Day of May, 1996

Bruce Lehman

BRUCE LEHMAN

*Commissioner of Patents and Trademarks*

*Attest:*

*Attesting Officer*